US005904430A

United States Patent [19]

Alessi

[11] Patent Number: 5,904,430

[45] Date of Patent: May 18, 1999

[54] DOUBLE DEPOSITING MARKING DEVICE

[75] Inventor: Darlene Alessi, Buffalo, N.Y.

[73] Assignee: May O'Shei, West Seneca, N.Y.

[21] Appl. No.: 08/969,855

[22] Filed: Nov. 14, 1997

[51] Int. Cl.[6] ..... B43K 27/00; B43K 27/08; B43K 8/02

[52] U.S. Cl. ..... 401/34; 220/4.27; 401/18; 401/207

[58] Field of Search ..... 401/18, 34, 57, 401/207; 206/509; 220/4.27

[56] References Cited

U.S. PATENT DOCUMENTS

| | | | |
|---|---|---|---|
| D. 341,387 | 11/1993 | Koneval | 401/34 X |
| 3,001,564 | 9/1961 | Hopkins | 206/509 X |
| 4,509,875 | 4/1985 | Shintani | 401/34 |
| 4,902,151 | 2/1990 | Asano et al. | 401/34 |
| 5,630,523 | 5/1997 | Wright | 220/4.27 X |

FOREIGN PATENT DOCUMENTS

| | | | |
|---|---|---|---|
| 2634273 | 2/1978 | Germany | 401/18 |
| 633452 | 12/1949 | United Kingdom | 401/57 |

*Primary Examiner*—Steven A. Bratlie
*Attorney, Agent, or Firm*—Hodgson, Russ, Andrews, Woods & Goodyear LLP

[57] ABSTRACT

A hand held marking device including a male marker and female marker for engagably fitting to one another. The hand held marking device provides for access to two daubers in fluid communication with different sources of ink in independent reservoirs.

12 Claims, 2 Drawing Sheets

DOUBLE DEPOSITING MARKING DEVICE

BACKGROUND OF THE INVENTION

1. Field of the Invention

The present invention pertains to devices for applying a fluid on a surface desired to be coated, and more particularly, the present invention relates to marking devices for applying ink on surfaces and the like.

2. Prior Art

Bingo is a game wherein the game player has a bingo card which comprises numerous square blocks, usually twenty-five, arranged in rows and columns, and each block containing a numeral therein. As the game master announces a number for a particular column, the game player marks the appropriate square.

Of course, quickly and effectively applying ink to bingo cards is important to the game player. It is very difficult to memorize the numbers called by the game master, and the corresponding squares on the bingo card to be marked. Game players presently use simple ink marking devices which allow the player to apply ink to the square called by the game master. Frequently, numerous bingo games are played simultaneously. Oftentimes in bingo, numerous games are played within games. Certain types of games require the game player to consider all the cards and remark particular blocks which may already have been daubed or coated with ink. This task becomes quite difficult and confusing when only one-colored ink is available to be used by the game player, as it is almost impossible to distinguish the old markings from the new markings.

Thus, game players presently use a plurality of different colored markers while playing bingo. A problem exists with this technique in that precious time is lost in putting down one marker, looking for a different colored marker, picking up and handling the new marker, and locating the square to be marked.

Hence, there is presently a great need for a marking device which allows the game player to place different colored inks on bingo cards, while permitting the game player to make the ink change quickly and efficiently, such that no time is wasted or burden imposed in making the color change. The present invention provides the solution to this long felt need.

SUMMARY OF THE INVENTION

It is an objective of the present invention to provide a hand held marking device which can apply at least two different colored inks, and which has at least two independent refillable ink reservoirs therein.

It is an objective of the present invention to provide a hand held marking device which is detachable into independent markers, and easily reattachable, and configured so that when so attached, the user can select which ink colors he or she wants to apply.

It is an objective of the present invention to provide a marking device which allows independent markers to be stackable and also arrangeable in a variety of different sequences.

Various other objectives and advantages will appear from the following description of the several embodiments of the present invention, and the novel features will be particularly pointed out hereinafter in connection with the appended claims.

The present invention includes a male marker and a female marker, each of which has a cap end located at one end thereof, the cap end having threads formed thereon. A dauber, meaning a small conical shaped porus pad which may be of felt material, is located at the cap ends, and is in fluid communication with ink reservoirs found in both the male and female markers. Caps are provided which are sized such that they threadably engage with the threads at the cap ends, and thus seal the daubers when the daubers are not in use, hence preventing the daubers from drying out due to exposure to the atmosphere.

The male marker has a male member opposite its cap end, and the female marker has a female member opposite its cap end. The male end of the male marker is removably fittable within the female end of the female marker. The result is a double marking device, in which the game player need only remove the end caps to expose the two daubers, and need only rotate the device to daub a different colored ink on the bingo card.

The present invention also provides a method for stacking additional male and female markers in between the markers in use. The cap is designed such that it mimics the male member of the male marker. Hence, the cap itself is releasably fittable within the female member, which provides enormous versatility in the embodiments of the present invention. For example, a male marker may be removable fitted in between two female markers, and the game player could use the daubers on the two female marking devices if desired. Also, a female marker may be inserted between a male marker and a female marker.

Hence, the present invention provides the game player with the ability to constantly have two exposed daubers available in a unitary hand held device, and permits the game player to stack male and female markers together as the game player desires, and exchange marking devices containing different ink colors.

These and other novel features of the present invention are shown in the following detailed description and appended claims.

BRIEF DESCRIPTION OF THE DRAWINGS

Briefly, the annexed drawings hereto show the following.

DETAILED DESCRIPTION OF THE PREFERRED EMBODIMENTS

Before turning to the drawings herein, as a preliminary note, common elements shown throughout the drawings are designated by the same numeral.

Figure 1:
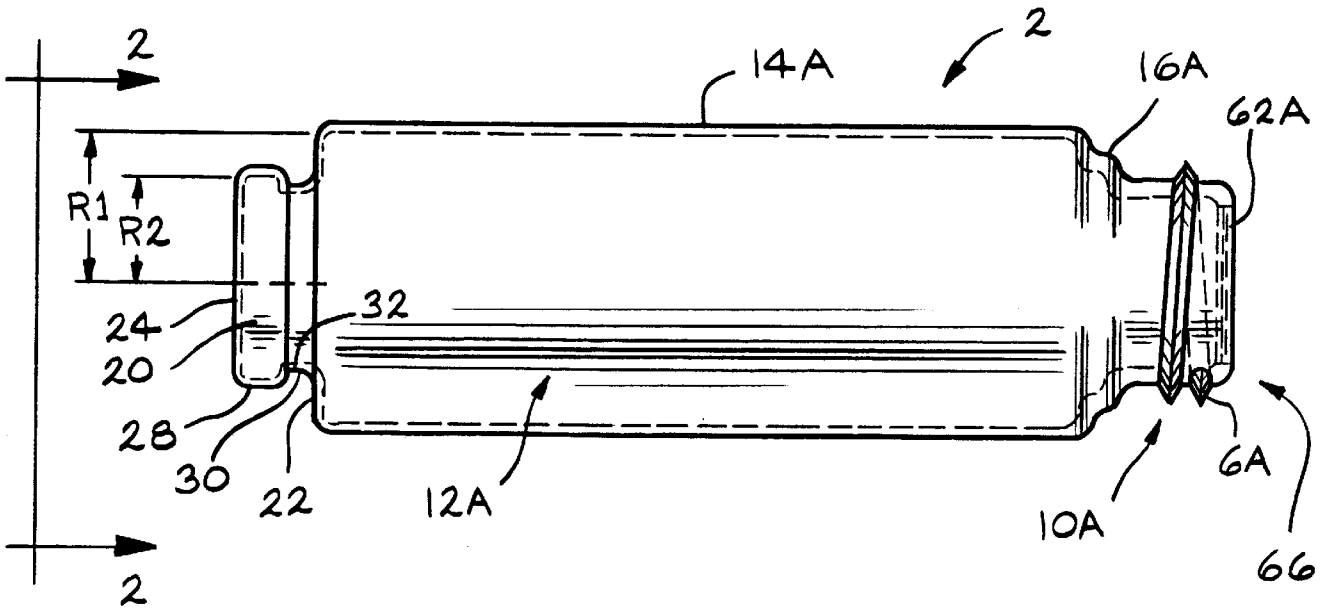
FIG. 1 is a side elevational view of the male marker.

Turning now to FIG. 1, shown in this illustrative embodiment of the present invention is a side elevational view of the male marker 2. At the outset is should be noted that the male marker 2, as well as the female marker 4 and cap 40, illustrated in FIG. 2, may be formed from any convenient pliable material, including plastics. Further, the male marker 2, the female marker 4, and the cap 40 may be formed by blow molding or injection molding using thermo-plastics or resins, or may be made by extrusion or pressure molding of thermosetting plastics or resins. All of these processes of manufacture are well known to those of ordinary skill in the relevant art.

In FIG. 1, the male marker 2 is formed so as to have a male member 20 which mergedly connects to a cylindrical body 14A, cylindrical body 14A merges into tapered shell 16A, and tapered shell 16A merges into male cap end 10A. At the male cap end 10A are formed the threads 6A. Internal to cylindrical body 14A, male member 20, and tapered shell 16A is defined the first liquid reservoir, designated 12A. First liquid reservoir 12A may be used to store a supply of ink which may be any color, such as red, orange, yellow, green, blue, indigo, violet, and combinations thereof.

Figure 3:
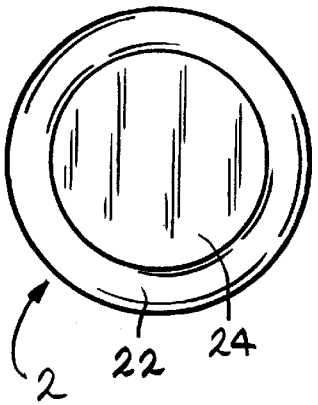
FIG. 3 is an end view of male end of the male marker taken along line 2—2.

The male member 20 is constructed such that it has a first end wall 24, and a second end wall 22, both of which are oriented perpendicular to the cylindrical body 14A. In FIG. 3, an end view of male marker 2 taken along line 2—2 of FIG. 1, shows first end wall 24 and second end wall 22. Referring again to FIG. 1, the male member 20 also includes a first surrounding cylindrical shell 28, which has a first radius designated schematically as R1, and a second surrounding cylindrical shell 30, which has a second radius designated schematically as R2, the first radius R1 being greater than the second radius R2. The male member 20 also is formed such that it includes a surrounding locking ring 32, which is located between the first surrounding cylindrical shell 28 and second surrounding cylindrical shell 30.

Continuing on with FIG. 1, male marker 2 is also constructed to have a dauber opening, designated 62A, defined at the male cap end 10A. Dauber opening 62A allows access to reservoir 12A, such that inks and the like can be transported through dauber opening 62A to reservoir 12A. Other uses of dauber opening 62A will be readily apparent from the below description.

Figure 2:
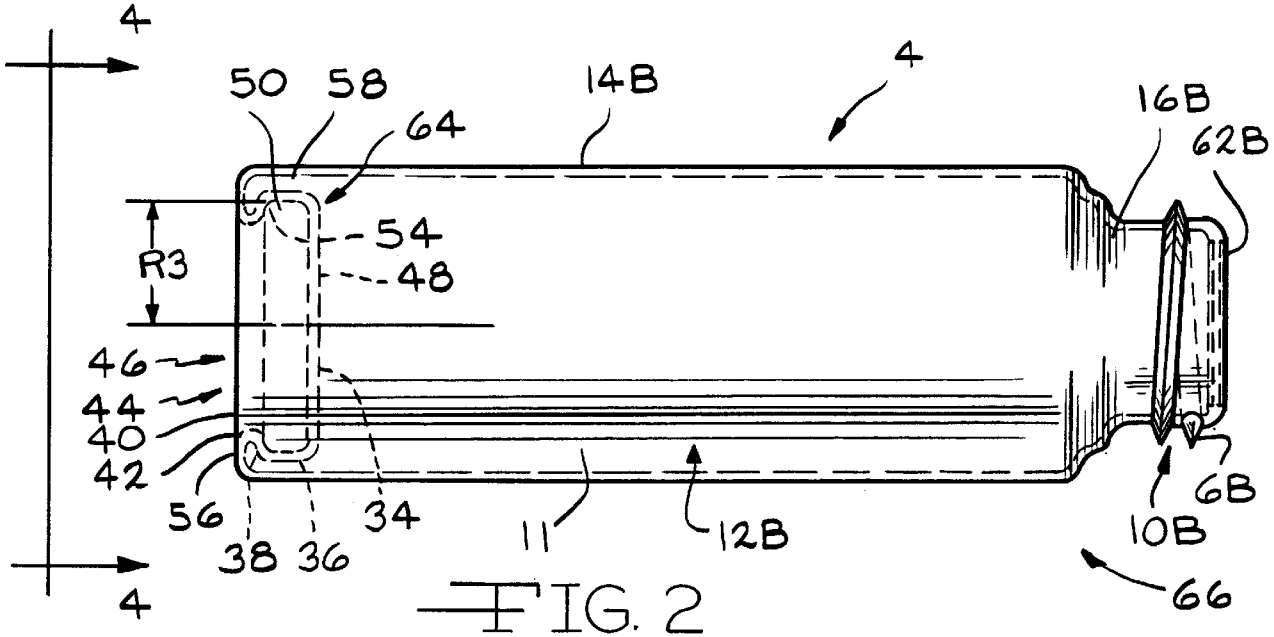
FIG. 2 is a side elevational view of the female marker.

Turning now to FIG. 2, illustrated therein is a side elevational view of the female marker 4. Female marker 4 is formed such that it has a female member 58, which mergedly connects to cylindrical body 14B, which merges into tapered shell 16B, which in turn merges into female cap end 10B. Female cap end is 10B formed to have external threads 6B thereon. A second liquid reservoir designated 12B is defined within the cylindrical body 14B, tapered shell 16B and female cap end 10B. Second liquid reservoir 12B is for holding inks of any color or shade, as previously discussed with respect to first reservoir 12A. At the female cap end 10B is formed a dauber opening, designated 62B, which serves to allow access to reservoir 12B for filling the reservoir, and the like.

Figure 4:
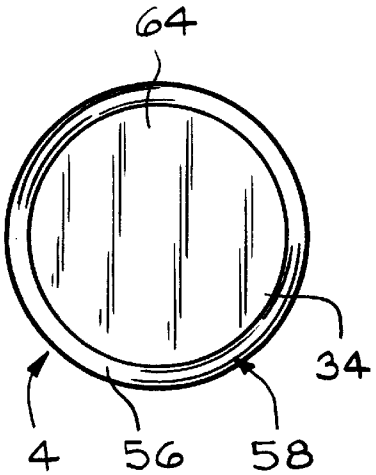
FIG. 4 is an end view of the female end of the female marker taken along line 4—4.

Continuing with FIG. 2, the female member 58, is more particularly constructed to include a stopping wall 34, a receiving shell 36, a latching ring 38, and an overlapping ring 56, these elements shaped to define a receptacle designated at reference number 64. The overlapping ring 56 defines the opening to receptacle 64, the opening having a radius designated R3. Shown in FIG. 4 is an end view of female marker 4 taken along line 4—4 of FIG. 2, the end view illustrating the female member 58 and receptacle 64 of female marker 4.

Figure 5:
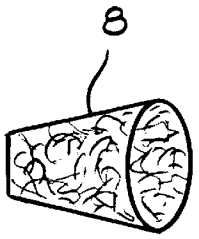
FIG. 5 is a plan view of the dauber means.

The present invention also requires the construction of a dauber means 8, which is best illustrated in the plan view shown in FIG. 5. Dauber 8 is for controllably releasing the ink from reservoir 12A and 12B. Dauber 8 may be constructed in a generally conical shape, as illustrated, and thus may be manually pressure fitted into and removed from the dauber openings 62A and 62B, and in this manner reservoirs 12A and 12B are quickly accessible. Dauber 8 may be constructed of a felt material, a synthetic fabric, a rubber based material, or any other suitable material porous enough to absorb and become saturated with an ink, yet not so porous as to allow the ink to flow unabated therethrough. Such other materials well known to those of ordinary skill in the relevant art. As such, dauber 8 places a controllable portion of ink on the surface to be coated.

Of course, when the dauber 8 is placed in openings 62A and 62B, it must be protected from the elements when not in use. Thus, the present invention provides for the construction of a cap 40, illustrated in FIG. 2, having internal thread grooves 44 which are threadably engagable with threads 6A and 6B. Screwing cap 40 to thread 6A or 6B results in sealing dauber 8 from the atmosphere 66, which prevents the depletion of the ink due to evaporation. Cap 40 is constructed so as to have a cylindrical cap shell 42 and a first engaging cap shell 50, an open cap side 46 for receiving the threads 6A or 6B as the case may be; and a closed cap side 48, for sealing the dauber 8 from the atmosphere 66 when the cap 40 is screwed to the thread 6A or 6B. Cap 40 is interchangeable, and will thread to either thread 6A or 6B, and is also, when so constructed, substantially similar to the male member 20.

With the male marker 2 and female marker 4 so constructed, the multiple configuration of these markers is next described. The most straightforward configuration of the markers is when they are inserted directly into one another, such that male member 20 is inserted into receptacle 64 in the female member 58. This is accomplished by moving the male member 20 adjacent to the receptacle 64, and then inserting the male member 20 into the receptacle 64. When this is done, the first surrounding cylindrical shell 28 contacts with the overlapping ring 56. The radius of the first surrounding cylindrical shell R1 is greater than the radius R3 of the receptacle 64. As additional force is applied on male marker 2 and female marker 4, the male member 20 to enter receptacle 64. As discussed fully above, the male marker 2 and the female marker 4 may be constructed of a pliable plastic material, and this characteristic permits the receiving shell 36 and the overlapping ring 56, and the latching shell 38 to expand outwardly to accommodate the first surrounding cylindrical shell 28. The first surrounding cylindrical shell 28 moves into the receptacle 64, until the first end wall 24 contacts stopping wall 34. In this position, the male marker 2 is releasably locked with female marker 4, as the surrounding locking shell 32 engages the latching shell 38, preventing the male marker 2 from releasing from the female marker 4. Also, in this locked position, the user now has a double depositing marker, which is capable of depositing two different colored inks, the ink color change possible by merely rotating the device.

Of course, the game player can release the male marker 2 from the female marker 4 by simply applying opposite forces to the male marker 2 and female marker 4. The first surrounding cylindrical shell 28 forces apart the receiving shell 36, the overlapping ring 56, and the latching shell 38, which permits the entire male member 20 to be released from female member 58. The game player can repeat the above steps to change colors of the markers, replace markers with exhausted ink supplies, and similar tasks.

There are also embodiments of the present invention which provide for more than one male marker 2 and more than one female marker 4 to be joined in a sequence. This is due to the fact that the cap 40 is constructed so as to mimic male member 20. Assuming the cap 40 is threaded to threads 6A or 6B, as the case may be, cap 40 is releasably fittable into the receptacle 64 in a manner identical to the above described manner for inserting the male member 20 into the receptacle 64. The first engaging cap shell 50 moves into the receptacle 64, and in doing so expands the overlapping ring 56, the latching shell 38, and the receiving shell 36. Cap 40 continues to move into the receptacle 64 until the closed cap side 48 contacts the stopping wall 34. The cap 40 is then releasably locked to the female marker 2, as the cap locking ring 54 lockably engages the latching shell 38 of the female marker 4. Of course, the game player can at any time remove cap 40 from female marker 4 by simply applying oppositely directed forces on the female marker 4 and the cap 40, which in turn causes the receiving shell 36, the latching shell 38, and the overlapping ring 56 to expand outwardly, which allows the first engaging cap shell 50 to be removed therefrom.

With the above description in mind, there are numerous embodiments of alternative sequences available when provided with a plurality of male markers 2 and female markers 4. For example, a plurality of female marker 4 could be attached together in a sequence. Such a sequence of female markers 4 might begin with a first female marker 4, releasably engaged with cap 40 of a second female marker 4, and releasably engaged with cap 40 of a third female marker 4, and so on and so forth. Another example includes releasably engaging the cap 40 or the male member 20 of the male marker 2 in the receptacle 64 of the female marker 4, and then releasably engaging another female maker 4 to the cap 40 or the male member 20 of the male marker 2, hence interdisposing the male marker 2 between two female markers 4. As apparent, with the above disclosure in mind, all the variational embodiments available under the present invention are all within the scope of the present invention, as if fully set forth herein.

Also, although the several drawings illustratively embody the present invention as being generally cylindrical in shape, the male marker 2 and female marker 4 can be alternatively embodied as having an elliptical shape, a square shape, a triangular shape, and the like.

It will be understood that various changes in the details, materials, steps and arrangements of parts, which have been herein described and illustrated in order to describe the nature of the present invention, may be made by those skilled in the art within the principle and scope of the invention as expressed in the appended claims.

What is claimed is:

1. A marking device for applying at least two marking liquids to a surface, which comprises:

a) a first housing having a first surrounding side wall extending to a closed bottom and a top portion having a first portal to provide the first housing enclosing a first internal volume accessible from outside the first housing through the first portal, wherein the closed bottom defines a female recess having a latching groove, and wherein the top portion of the first housing is closable by a first closure means;

b) a second housing having a second surrounding side wall extending to a closed bottom portion and a top portion having a second portal to provide the second housing enclosing a second internal volume accessible from outside the second housing through the second portal, wherein the closed bottom defines a male member having a first locking means that is releasably matable with the latching groove of the first housing to releasably mate the bottom of the first housing to the bottom of the second housing with the respective first and second portals extending in opposing directions; and c) a second closure means provided at the top portion of the second housing, wherein the second closure means has a second locking means that is releasably matable with the latching groove of the first housing to provide the second housing selectively matable with the first housing by the first locking means of the male member received in the female recess or with the second locking means of the second closure means received in the female recess of the first housing.

2. The marking device of claim 1 wherein the male member of the second housing comprises:

a) the second surrounding sidewall having a cylindrical shape of a first radius;

b) a third cylindrical surrounding sidewall having a second radius being less than the first radius; and c) a surrounding locking sidewall interdisposed between the second surrounding cylindrical sidewall and the third surrounding cylindrical sidewall for lockably releasing the male member to the female recess.

3. The marking device of claim 1 wherein the female member further comprises:

a) a cylindrical sidewall as the first surrounding side wall forming into a stopping wall;

b) a receiving shell extending from a perimeter of the stopping wall;

c) an overlapping ring connected to the receiving shell by an intermediate latching ring, wherein the stopping wall, the receiving shell, the overlapping ring, and the latching ring define the female recess for receiving the male member and releasably holding the male member matably engaged to the female recess with the stopping wall contacting the male member.

4. The marking device of claim 1 made of a flexible material.

5. The marking device of claim 4 wherein the flexible material is selected from the group consisting of thermosetting plastics, thermosetting resins thermo-plastics, and thermo-resins.

6. The marking device of claim 1 wherein the first locking means of the male member of the second housing is a first locking ring.

7. The marking device of claim 1 wherein the second locking means of the second closure means is a second locking ring.

8. The marking device of claim 1 wherein the top portion of the first housing is provided with threads that are matable with the first closure means as a first cap closing the first portal.

9. The marking device of claim 1 wherein the top portion of the second housing is provided with threads that are matable with the second closure means as a second cap closing the second portal.

10. The marking device of claim 1 wherein the first portal is provided with a first dauber in fluid flow communications with the first internal volume and a first liquid contained therein, and wherein the first dauber controllably releases the first liquid when the marking device is manipulated to contact the first dauber to a surface to be marked.

11. The marking device of claim 1 wherein the second portal is provided with a second dauber in fluid flow communication with the second internal volume and a second liquid contained therein, and wherein the second dauber controllably releases the second liquid when the marking device is manipulated to contact the second dauber to a surface to be marked.

12. A method for applying at least two marking liquids to a surface, comprising the steps of:

a) providing a first housing having a first surrounding side wall extending to a closed bottom and a top portion having a first portal to provide the first housing enclosing a first internal volume accessible from outside the first housing through the first portal, wherein the closed bottom defines a female recess having a latching groove, and further closing the top portion of the first housing by a first closure means;

b) providing a second housing having a second surrounding side wall extending to a closed bottom portion and a top portion having a second portal to provide the second housing enclosing a second internal volume accessible from outside the second housing through the second portal, wherein the closed bottom defines a male member having a first locking means;

c) releasably mating the bottom of the first housing to the bottom of the second housing with the latching groove of the first housing releasably mated to the male member at the bottom of the second housing with the respective first and second portals extending in opposing directions;

d) providing a second closure means closing the top portion of the second housing, wherein the second closure means has a second locking means that is releasably matable with the latching groove of the first housing; and e) releasably mating the top portion of the second housing to the bottom of the first housing with the second locking means of the second closure means received in the female recess of the first housing.

* * * * *